US006797082B1

(12) United States Patent
Guixà Arderiu et al.

(10) Patent No.: US 6,797,082 B1
(45) Date of Patent: Sep. 28, 2004

(54) MANUFACTURE OF COPPER MICROALLOYS

(75) Inventors: José Oriol Guixà Arderiu, Barcelona (ES); Miquel Garcia Zamora, Moia (ES); Ferran Espiell Alvarez, Barcelona (ES); Miquel Angel Fernández López, Barcelona (ES); Araceli Esparducer Broco, Sant Pere de Ribes (ES); Mercè Segarra Rubik, Barcelona (ES); Josep Ma Chimenos Ribera, Barcelona (ES)

(73) Assignee: La Farga Lacambra, S.A., Barcelona (ES)

( * ) Notice: Subject to any disclaimer, the term of this patent is extended or adjusted under 35 U.S.C. 154(b) by 0 days.

(21) Appl. No.: 09/499,207

(22) Filed: Feb. 7, 2000

(30) Foreign Application Priority Data

Feb. 8, 1999 (ES) ..... 9900254

(51) Int. Cl.[7] ..... C22F 1/08
(52) U.S. Cl. ..... 148/553; 148/686
(58) Field of Search ..... 148/553, 686

(56) References Cited

U.S. PATENT DOCUMENTS

| | | | | |
|---|---|---|---|---|
| 3,551,622 A | 12/1970 | Takeuchi | ..... | 200/144 |
| 4,792,369 A | 12/1988 | Ogata et al. | ..... | 148/404 |
| 5,077,005 A | 12/1991 | Kato | ..... | 420/469 |
| 6,103,188 A | 8/2000 | Guixa Arderiu et al. | .... | 420/473 |

FOREIGN PATENT DOCUMENTS

| | | | |
|---|---|---|---|
| EP | 290311 | | 11/1988 |
| JP | 61133351 | * | 6/1986 |
| JP | 62047443 | * | 3/1987 |
| JP | 62133050 | * | 6/1987 |
| JP | 9078162 | * | 3/1997 |
| JP | 10195562 | * | 7/1998 |

* cited by examiner

*Primary Examiner*—Sikyin Ip
(74) *Attorney, Agent, or Firm*—Darby & Darby

(57) ABSTRACT

The invention refers to batch casting, semi-continuous casting or continuous casting and rolling of copper, providing the addition of lead or refining the melt copper or the melt microalloyed copper to a lead content equal to or higher than 200 weight ppm. This minimizes the number of pores and defects, decreasing the number of incidences or breaks during casting and in service. However, it does not reduce the electrical conductivity. The addition of lead allows the cast and roll of copper microalloyed with elements such as S, Se, As, Sb, Bi, Sn, Zn, Ni, Fe, Ag and Te, in concentrations of the order of tens of weight ppm. The copper microalloys manufactured in this way have annealing temperatures and strain strengths higher than those obtained from the equivalent tough-pitch copper or the equivalent microalloyed copper with lead content lower than 15–20 weight ppm.

4 Claims, 1 Drawing Sheet

MANUFACTURE OF COPPER MICROALLOYS

This patent application claims priority under 35 U.S.C. § 119 from Spain Patent Application No. 9900254, filed Feb. 8, 1999.

FIELD OF THE INVENTION

The present invention relates to the manufacture of copper microalloys, particularly the casting copper by conventional batch casting, semi-continuous casting or continuous casting and of rolling tough-pitch copper or microalloyed copper. It provides the addition of lead or refining to a final concentration of lead equal to or higher than 200 ppm. This allows the casting of copper microalloyed with elements such as S, Se, As, Sb, Bi, Sn, Zn, Ni, Fe, Ag and Te in amounts of the order of tens of weight ppm.

This invention also relates to a pre-heating treatment which has been discovered to be necessary to let some copper microalloys with a lead concentration equal to or higher than 200 ppm have the same strain strength, annealing temperature, half-softening temperature and recrystallization temperature as those obtained for tough-pitch copper, and an electrical conductivity equal to or higher than 101.5% IACS.

BACKGROUND OF THE INVENTION

Until recently, it was accepted that a lead content in melt copper higher than 15–20 weight ppm, and a high content of other impurities was undesirable due to reduction of the electrical conductivity and the formation of high number of defects and bubbles in a phenomena known as hot-shortness. This meant that only tough-pitch copper could be cast. Thus blister copper or copper scrap refined by pyrometallurgical methods, which gave a lead content lower than 15–20 weight ppm, and decreased sufficiently impurities to produce high electrical conductivity copper, was not technologically competitive compared to electrolytically-refined copper.

Despite all the related handicaps in the fire-refining process and in the products, some companies developed different slagging agents in order to achieve the purity of tough-pitch copper while avoiding the expensive process of electrolytical refining. Nevertheless, it was difficult to decrease lead content to values lower than 15–20 weight ppm by fire-refining. The fire-refined copper produced was a high quality product, with electrical, thermal and mechanical properties very similar to electrolytically-refined copper, but because of its high lead content, it was often impossible to cast or roll, or else the final product was brittle and susceptible to breakage due to the porosity in the metal.

It is also known that a pre-heating treatment at 550–650° C. for one hour or longer before high cold-working (80% or more) on microalloys with a lead content higher than 15–20 ppm significantly decreases their annealing temperature, half-softening temperature and recrystallization temperature, and also increases the electrical conductivity. Some compositions of microalloyed copper, treated with this pre-heating process achieve similar mechanical, thermal and electrical properties to tough-pitch copper.

OBJECT OF THE INVENTION

To find a solution to the above mentioned drawbacks, the inventors have carried out investigations which have led to this invention, providing in a process for the discontinuous, semi-continuous or continuous casting of copper or microalloyed copper, the addition of lead or refining to a final concentration of lead equal to or higher than 200 weight ppm. Surprisingly-enough, this allows the casting and rolling of microalloys with impurities such as S, Se, As, Sb, Bi, Sn, Zn, Ni, Fe, Ag and Te in concentrations of the order of tens of weight ppm.

The invention refers well to an optional pre-heating treatment at 550–650° C. for 5–600 seconds which, when applied to some copper microalloys with a lead content equal to or higher than 200 weight ppm, leads to a decrease in their strain strengths, giving annealing temperatures, half-softening temperatures or recrystallization temperatures equal to or lower than 200° C., thereby obtaining mechanical, thermal and electric properties similar to ETP-CU.

SUMMARY OF THE INVENTION

This invention is based on the following:

a) Lead concentrations higher than 200 weight ppm in copper and copper microalloys secure their castability by conventional casting (by batch, semi-continuous or continuous casting) and their rolling because of their low hot-shortness, and the number of breaks in the cast bar decreases. The improvement in the microstructure in terms of small number of voids and bubbles also ensures a small number of breaks at lower values of tensile strength and elongation than the statistically established.

b) Lead concentrations higher than 200 weight ppm secure the casting and rolling of copper microalloys containing microalloying elements such as S, Se, As, Sb, Bi, Sn, Zn, Ni, Fe, Ag and Te in the order of tens of weight ppm.

c) A pre-heating treatment at 550–650° C. for 5–600 s on copper with impurity contents lower than 80 weight ppm of elements Sn, Zn, Ni, Ag, Cd, Sb, S and Fe that have been cast by the addition of lead or refining until a lead content in the solid product higher than 300 weight ppm decreases their half-softening temperature, annealing temperature and recrystallization temperature to values lower than 200° C.

DETAILED DESCRIPTION

Figure 1:
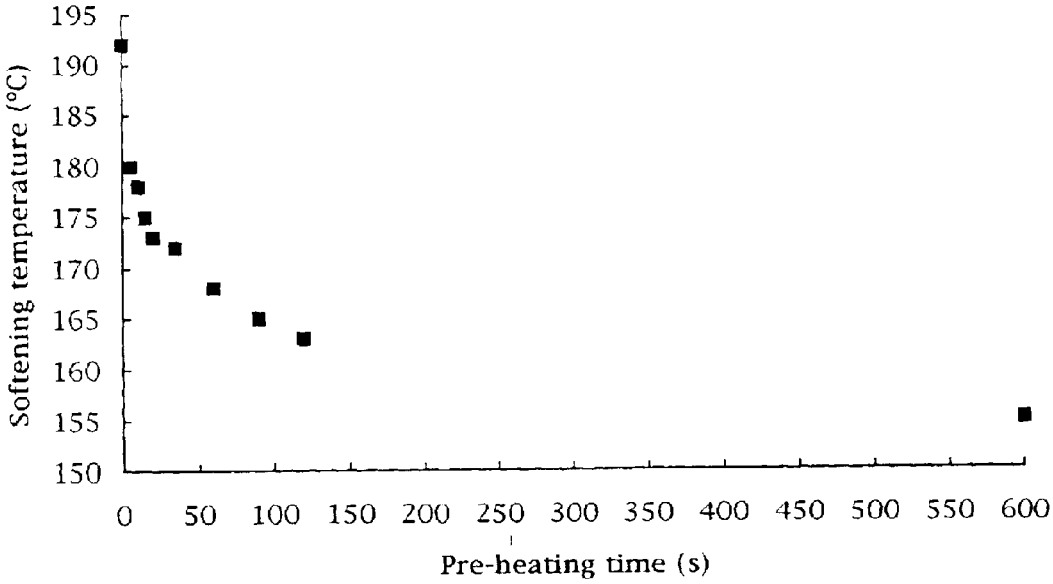
FIG. 1 depicts the variation in the Softening temperature with the pre-heating time at 586° C. in sample 1.

It is known that for a lead content in copper lower than 15–20 weight ppm and an oxygen content between 60–400 weight ppm, casting and rolling problems caused by the high hot-shortness are not usual, and the final product has a low number of voids and bubbles. Impurities such as S, Se, As, Sb, Bi, Sn, Zn, Ni, Fe, Ag and Te at concentrations less than 5–10 weight ppm are also desirable in order to secure the casting and rolling of copper.

In contrast, copper with more than 15–20 weight ppm of lead and/or other impurities such as S, Se, As, Sb, Bi, Sn, Zn, Ni, Fe, Ag and Te in contents in the order of tens of weight ppm has casting and rolling problems and its microstructure has a high number of defects which are large enough to break the cast bar during casting. This is one of the reasons why most of the copper smelters and refiners have adopted the electrolytically-refining method.

The formation of casting bubbles and defects can be attributed to the elimination of hydrogen. Hydrogen is formed in the reduction reaction, in which methane is burnt in the reduction furnace. As the lead content increases, the amount of solved hydrogen also increases, reaching the maximum content in hydrogen that in those conditions can be solved in copper when the lead content is between 15–20 and 200 weight ppm. When this copper microalloy is being cast, the excess solved hydrogen is eliminated by the formation of bubbles and voids that can break the casting bar.

Experiments carried out in accordance with the present invention show surprising results because for a lead content in copper higher than 200 weight ppm, the number of bubbles and voids formed during casting decreases markedly, allowing the casting and rolling of this copper. This may be because the atomic volume of lead is greater than that of copper. The substitution of copper by lead in the crystal net creates interstices that can be occupied by hydrogen.

Another surprising result is that a lead content in copper higher than 200 weight ppm secures or even improves the castability and rolling of copper microalloys with impurities such as S, Se, As, Sb, Bi, Sn, Zn, Ni, Fe, Ag and Te when their contents are of the order of tens of weight ppm, in comparison with the castability of copper with less than 15 ppm of lead. A comparison between the microstructure of casting bars with a lead content lower than 15–20 weight ppm and others with high amounts of microalloying elements and a lead content higher than 300 weight ppm, shows a low number of bubbles and defects in the latter.

However, because of the high lead content, copper microalloys obtained by this casting method have higher strain strengths, higher recrystallization temperatures, higher softening temperatures and higher annealing temperatures than those obtained from the copper or copper microalloys with equivalent compositions but a lead content lower than 15–20 weight ppm.

The invention, in order to improve the above mentioned aspect introduces an optional thermal treatment at 550–650° C. known as pre-heating. This treatment decreases the softening temperature, annealing temperature and recrystallization temperature in copper and copper microalloys when the lead content is higher than 15–20 weight ppm. This phenomenon is related to the presence of hydrogen in copper and copper microalloys, because pre-heating decreases the hydrogen and oxygen content. The hydrogen content is around 0.5–0.7 weight ppm after casting by this method, and decreases until there is no detectable hydrogen after a complete pre-heating, when the softening temperature, annealing temperature and recrystallization temperature reach their minimum value, normally after long pre-heating times (2 hours or more).

Another surprising result of the invention is that some coppers, cast after securing a lead content higher than 300 weight ppm, have fast pre-heating kinetics, with a decrease in softening temperature, annealing temperature and recrystallization temperature by a maximum of 30° C. in 10 minutes and more specifically, achieving softening temperatures, annealing temperatures and recrystallization temperatures lower than or around 200° C. after 5–600 s of pre-heating. These coppers have a content lower than 80 weight ppm of other elements such as Sn, Zn, Sb, Cd, Ni, Fe, Bi and S, but a high lead content, always higher than 300 weight ppm and preferably higher than 350 weight ppm. Pre-heating removes hydrogen from the interstitial positions next to lead, forming water, which explains the decrease in oxygen content observed after pre-heating. A low content of microalloying elements which have a higher affinity for oxygen than copper, such as those described above assists the formation of water, improving the pre-heating kinetics.

The major advantages of this invention are as follows:

i) A lead content higher than 200 weight ppm secures the casting and rolling of copper and copper microalloys, even with impurities in copper microalloys of tens of weight ppm of elements such as S, Se, As, Sb, Bi, Sn, Zn, Ni, Fe, Ag and Te.

ii) The optional pre-heating treatment proposed often increases the electrical conductivity of the described copper microalloys in comparison with equivalent coppers of the same composition but with lead contents lower than 15–20 weight ppm.

EXAMPLES

Table 1 shows coppers and copper microalloys produced by semi-continuous casting in an industrial plant by the method proposed, starting from copper scrap that had been fire-refined. Copper microalloys with an Sb content of 20 weight ppm or more and a S content between 3 and 12 weight ppm were cast and rolled with low hot-shortness. Table 2 shows the softening temperatures (defined as the temperature at which the strain strength starts decreasing after 80% cold-working) of the coppers and copper microalloys described in table 1.

Sample 1 is a copper microalloy as described above which showed a rapid pre-heating. FIG. 1 shows that in 10 s of pre-heating, the softening temperature decreased from 192° C. to 178° C., reaching 155° C. after 600 s.

Advantages of the Invention

As described above, the present invention provides a new method for casting and rolling copper and copper microalloys, even with microalloying elements such as S, Se, As, Sb, Bi, Sn, Zn, Ni, Fe, Ag and Te in amounts in the order of tens of weight ppm, by batch, semi-continuous or continuous casting that reduces the residence time and energy costs of a fire-refining copper production plant, and gives a casting product with low hot-shortness which has low number of failures in service. Despite the small increase in the softening temperature, annealing temperature and recrystallization temperature, and the decrease in the electrical conductivity of the product produced by this method, compared with the equivalent copper or copper microalloy of the same composition but with a lead content lower than 15–20 weight ppm, the use of a fast and economical heat treatment, known as pre-heating, decreases the softening temperature, annealing temperature and recrystallization temperature of some copper compositions cast by the proposed method to values less than or around 200° C. and leads to the electrical conductivity of tough-pitch copper or even higher

TABLE 1

Examples of some copper compositions and copper microalloys cast by this method (in weight ppm)

| Sample | Pb | Sn | Ni | Ag | Cd | Bi | Sb | Fe | Zn | S | Oxygen |
|---|---|---|---|---|---|---|---|---|---|---|---|
| 1 | 479 | 65 | 25 | 28 | 0.3 | 0.9 | 11 | 11 | 39 | 3 | 168 |
| 2 | 460 | 23 | 14 | 18 | 0.2 | 0.6 | 20 | 21 | 15 | 6 | 163 |
| 3 | 322 | 11 | 9 | 9 | 0.8 | 0.8 | 5 | 5 | 6 | 5 | 178 |
| 4 | 520 | 50 | 32 | 19 | 0.9 | 0.8 | 15 | 14 | 23 | 12 | 218 |
| 5 | 345 | 46 | 34 | 23 | 1.1 | 1.0 | 21 | 28 | 24 | 9 | 195 |
| 6 | 247 | 50 | 30 | 43 | 0.9 | 1.2 | 22 | 34 | 14 | 6 | 171 |
| 7 | 236 | 121 | 106 | 59 | 0.8 | 0.7 | 17 | 27 | 57 | 6 | 154 |
| 8 | 341 | 81 | 61 | 52 | 0.8 | 0.6 | 18 | 29 | 80 | 7 | 148 |

TABLE 1-continued

| Examples of some copper compositions and copper microalloys cast by this method (in weight ppm) | | | | | | | | | | | |
|---|---|---|---|---|---|---|---|---|---|---|---|
| Sample | Pb | Sn | Ni | Ag | Cd | Bi | Sb | Fe | Zn | S | Oxygen |
| 9 | 388 | 74 | 69 | 70 | 0.6 | 0.7 | 22 | 26 | 81 | 10 | 150 |

TABLE 2

| Sample | Softening temperature (° C.) |
|---|---|
| 1 | 192 |
| 2 | 192 |
| 3 | 198 |
| 4 | 200 |
| 5 | 210 |
| 6 | 222 |
| 7 | 230 |
| 8 | 242 |
| 9 | 242 |

Although the invention has been explained based on the aforegoing description and examples it is obvious that the men of the art will find variations which will be included in the field covered by the invention provided that they do not depart from the enclosed claims.

What we claim is:

1. A method for the manufacture of a copper microalloy comprising:

(a) mixing a copper alloy consisting of copper and one or more of S, Se, As, Sb, Bi, Sn, Zn, Ni, Fe, Ag and Te impurities in amounts of the order of items of weight ppm, with lead to yield a microalloy having a final concentration of at least 200 weight ppm of lead, wherein the copper alloy contains Zn, Fe, Ni, Sn, and Ag impurities in amounts of the order of tens of weight ppm; and (b) continuous casting the microalloy.

2. The method of claim 1, wherein the microalloy has a lead content of more than 300 weight ppm.

3. The method of claim 1, wherein the microalloy has a lead content of more than 350 weight ppm.

4. The method of claim 1, wherein the microalloy from step (b) is heated at 550–650° C. for 5–600 seconds to decrease its softening temperature, annealing temperature and recrystallization temperatures to below 200° C.

* * * * *